US007748193B2

(12) United States Patent
Knigge et al.

(10) Patent No.: US 7,748,193 B2
(45) Date of Patent: Jul. 6, 2010

(54) PUMPING TOWER SUPPORT SYSTEM AND METHOD OF USE

(75) Inventors: Walter N. Knigge, Racine, WI (US); C. William Carbeau, Naples, FL (US)

(73) Assignee: Putzmeister America, Inc., Sturtevant, WI (US)

( * ) Notice: Subject to any disclaimer, the term of this patent is extended or adjusted under 35 U.S.C. 154(b) by 537 days.

(21) Appl. No.: 11/621,733

(22) Filed: Jan. 10, 2007

(65) Prior Publication Data

US 2007/0157539 A1 Jul. 12, 2007

Related U.S. Application Data

(60) Provisional application No. 60/758,472, filed on Jan. 12, 2006.

(51) Int. Cl.
*E04H 12/00* (2006.01)

(52) U.S. Cl. ..... 52/651.1; 52/126.1; 212/176; 212/296

(58) Field of Classification Search ..... 212/176, 212/296; 182/82; 52/651.1; 403/150, 153, 403/154, 155, 318; 248/200.1
See application file for complete search history.

(56) References Cited

U.S. PATENT DOCUMENTS

| | | | | | |
|---|---|---|---|---|---|
| 279,740 | A | * | 6/1883 | Gillett | 182/146 |
| 1,788,451 | A | | 1/1931 | Clapp | |
| 3,127,996 | A | * | 4/1964 | Schwing | 212/176 |
| 3,153,486 | A | * | 10/1964 | Strnad | 414/564 |
| 3,656,631 | A | | 4/1972 | Rauch et al. | |
| 3,938,670 | A | * | 2/1976 | Wellman | 212/296 |
| 4,054,014 | A | | 10/1977 | van der Lely | |
| 4,205,826 | A | * | 6/1980 | Ten Broeke et al. | 254/89 R |
| 4,274,542 | A | * | 6/1981 | Barclay | 212/270 |
| 4,374,790 | A | | 2/1983 | McGowan | |
| 4,496,277 | A | | 1/1985 | Jungman | |
| 4,696,135 | A | | 9/1987 | Kallinger et al. | |
| 4,809,814 | A | * | 3/1989 | St-Germain | 182/132 |
| 5,159,993 | A | * | 11/1992 | St-Germain | 182/82 |
| 5,259,479 | A | * | 11/1993 | St-Germain | 182/146 |
| 5,367,852 | A | * | 11/1994 | Masuda et al. | 52/651.06 |

(Continued)

FOREIGN PATENT DOCUMENTS

| | | |
|---|---|---|
| GB | 994 728 | 6/1965 |

(Continued)

*Primary Examiner*—David Dunn
*Assistant Examiner*—Joshua Ihezie
(74) *Attorney, Agent, or Firm*—Andrus, Sceales, Starke & Sawall, LLP

(57) ABSTRACT

A support system is provided for supportably securing a vertically movable support structure having a boom attached thereto to a floor structure of a building. The support structure extends through an opening formed in the floor structure. The support system includes a set of support brackets pivotably mounted relative to vertical support members of the support structure. The support brackets are supportably engageable with a portion of the support structure and a first floor structure in a first supporting position. The support brackets are freely swingable and movably engageable with a second floor structure as the support structure is moved relative to the second floor structure enabling the support brackets to be supportably engageable with the portion of the support structure and the second floor structure in a second supporting position.

4 Claims, 8 Drawing Sheets

U.S. PATENT DOCUMENTS

| | | | | | |
|---|---|---|---|---|---|
| 5,450,695 | A | * | 9/1995 | Desai | 52/118 |
| 5,579,865 | A | * | 12/1996 | Butler et al. | 182/141 |
| 5,746,290 | A | * | 5/1998 | St-Germain et al. | 182/146 |
| 5,807,059 | A | * | 9/1998 | Takeda | 414/609 |
| 5,839,239 | A | | 11/1998 | Jang | |
| 5,901,864 | A | | 5/1999 | Morrow | |
| 5,980,190 | A | * | 11/1999 | Takeda | 414/609 |
| 6,226,955 | B1 | * | 5/2001 | Lorrigan | 52/745.05 |
| 6,357,549 | B1 | | 3/2002 | Brennan et al. | |
| 6,470,629 | B1 | | 10/2002 | Haddock | |
| 6,533,068 | B1 | | 3/2003 | Reed | |
| 6,668,497 | B1 | * | 12/2003 | Mayer et al. | 52/126.1 |
| 2002/0178683 | A1 | * | 12/2002 | Phillips | 52/651.1 |
| 2003/0121875 | A1 | | 7/2003 | Davis et al. | |

FOREIGN PATENT DOCUMENTS

| | | |
|---|---|---|
| JP | 05 155580 | 6/1993 |
| JP | 2006 103832 | 4/2006 |

* cited by examiner

FIG. 3
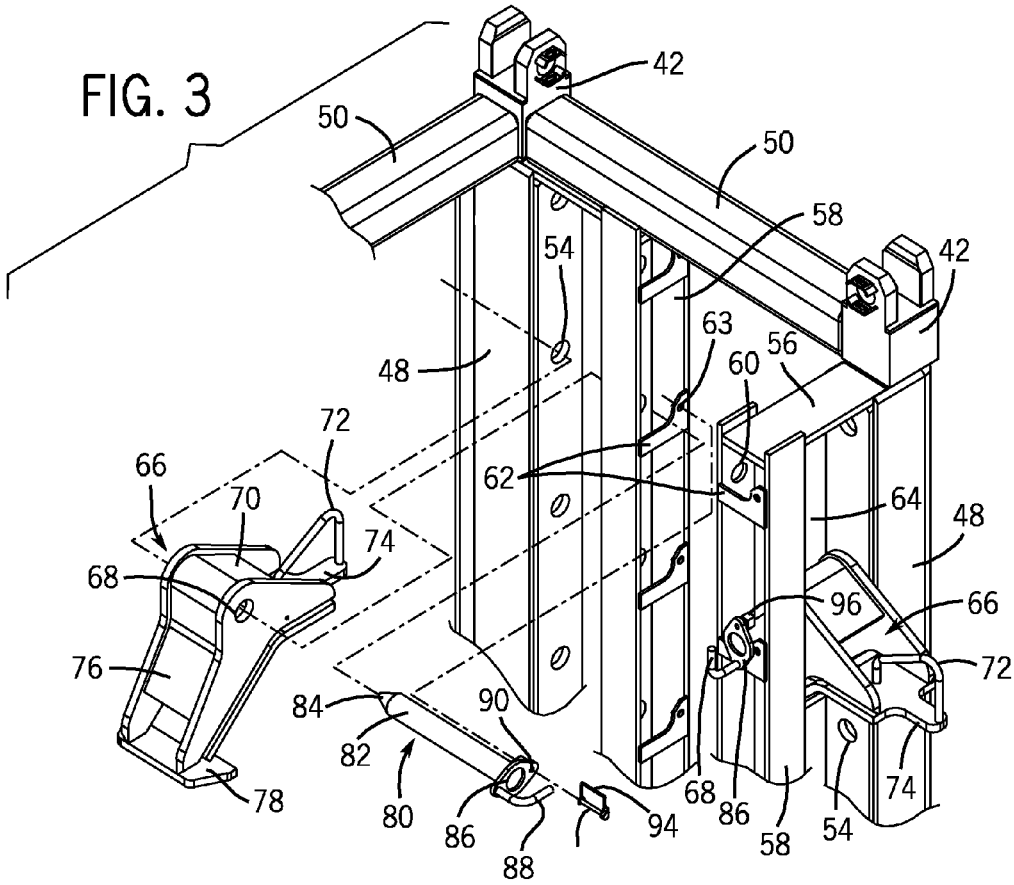
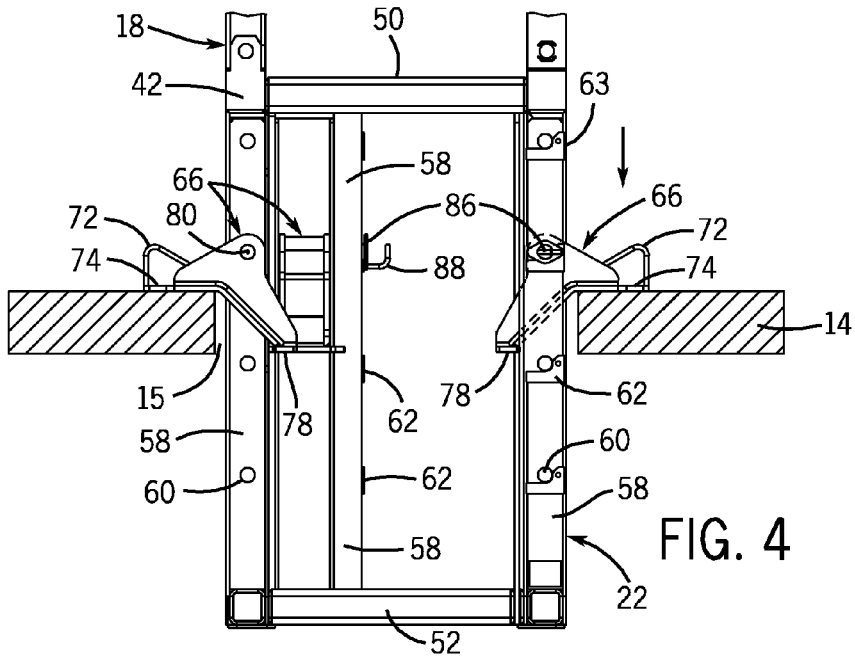
FIG. 4

PUMPING TOWER SUPPORT SYSTEM AND METHOD OF USE

CROSS-REFERENCE TO RELATED APPLICATION

This application relates to and claims priority from U.S. Provisional Patent Application Ser. No. 60/758,472 filed Jan. 12, 2006.

FIELD OF THE INVENTION

The present invention relates generally to a tower-to-floor support system that more effectively allows a vertically movable tower-supported concrete placing boom to be supported at different vertical positions relative to the floor structure development of a building under construction.

BACKGROUND OF THE INVENTION

Currently, concrete placing booms are used at large work sites such as the construction of a multi-floored building for placing concrete in hard to access locations. Typically, the concrete placing boom is removably mounted to a support structure, such as a pumping tower, that passes through the developing floor structure of a building, and extends above a working surface such that concrete can be supplied from above. The concrete placing boom can be removed from one pumping tower and lifted such as by a crane to another pumping tower, if desired.

The pumping tower holding the concrete placing boom can be supported by the ground floor structure and/or by the floor structures through which the pumping tower passes. In the latter situation, there needs to be a mechanism by which the floor structures support the pumping tower after the pumping tower is raised by either an on-site crane or a specially designed climbing system that hydraulically jacks the tower up using the floor structures as the support base.

Regardless of the means used for lifting the concrete placing boom and the pumping tower, on-site workers must mechanically add some means of securing the support mechanism once the pumping tower is raised to a certain floor position aligned with the support mechanism. This typically involves lining up holes for pin(s) to be inserted or a protrusion or cradle method. Both methods are labor intensive and time consuming, and are known to be user-unfriendly involving a great deal of worker manipulation while operating with a tower crane and inexact openings. Some support mechanisms exist in which outriggers are powered to move feet or other members into engagement with stubs or other support members at desired levels of the building being constructed. However, these arrangements are generally complex in nature and can be unreasonably expensive.

Therefore, there is a need to provide a simplified yet highly effective support system for supportably securing a vertically movable tower to a floor structure of a building in a manner which greatly decreases the time and effort involved in securing the tower. Further, there is a need to provide a tower-to-floor support system which is substantially automatic and employs a set of support brackets which do not require any additional power mechanism for effecting their movement during securement of the tower to the floor structure. Additionally, there is a need for a tower-to-floor support system that can be used regardless of the means used to raise the tower relative to the floor structure.

SUMMARY OF THE INVENTION

The present invention relates to a support system for supportably securing a vertically movable support structure to a floor structure of a building. The support structure extends through an opening formed in the floor structure. The support system includes a set of support brackets pivotably mounted relative to vertical support members of the support structure. The support brackets are supportably engageable with a portion of the support structure and a first floor structure in a first supporting position. The support brackets are freely swingable and movably engageable with a second floor structure as the support structure is moved relative to the second floor structure enabling the support brackets to be supportably engageable with the portion of the support structure and the second floor structure in a second supporting position.

The support structure is preferably a lattice tower having an upper end provided with a concrete placing boom, and a lower end connected to a support framework. The support framework includes a series of vertical legs and vertical racks, and the support brackets are pivotably mounted on a horizontal axis between the vertical legs and vertical racks of the support framework.

Each support bracket has a first portion with a guide and a first stop, and a second portion with a second stop. The second portion is generally longer than the first portion. In one of the first and second supporting positions, the first stop is engageable with a top of either of the first and second floor structures, and the second stop is engageable with the vertical leg and the vertical rack. Between the first and second supporting positions, the guide is engageable with the bottom surface of the second floor structure and the surface forming the second floor structure opening. Each support bracket is engageable about a pivot pin having a cylindrical section provided with one end which is pointed, and an opposite end provided with a face plate having a tab and a handle. The pivot pin extends through a hole formed in the vertical leg, a mounting aperture formed in the support bracket and an opening formed in the vertical rack. The vertical rack has a stop attached thereto adjacent the opening. The handle and the faceplate are rotatable to engage the tab behind the stop, and a retainer is passed through the faceplate and the stop to lock the pivot pin in position.

Wedges are provided on the first and second floor structures. The wedges are engageable with corner members of the lattice tower in the first and second supporting positions.

The invention further contemplates a method of securing a vertically movable support structure to a multi-level floor structure of a building wherein the support structure extends through an opening formed in the floor structure. The method includes the steps of a) providing a set of support brackets pivotably mounted relative to vertical support members of the vertical support structure, the support brackets being supportably engageable with a portion of the support structure and a first floor structure in a first supporting position, and being freely swingable and movably engageable with a second floor structure in second supporting position, there being a wedge arrangement installed at corners of the floor structures with the support structure being fully supported on the first floor structure by the support brackets; b) removing the wedge arrangement from corners of the floor structure; c) raising the support structure and causing the support brackets to disengage from the first floor structure and the portion of the support structure such that the support brackets swing freely against and over a top of the second floor structure; d) lowering the support structure causing the support brackets to engage the second floor structure and the portion of the support structure so that the support structure is fully supported on the second floor structure; and e) replacing the wedge arrangement at corners of the second floor structure and a subsequent third floor structure.

The method includes the steps of a) providing a concrete placing boom at a top of the support structure; b) removing the concrete placing boom and attaching a lifting device before the step of raising the support structure; and c) removing the lifting device and reattaching the concrete placing boom as the support structure is moved upwardly from one floor structure to another floor structure and secured thereon.

Various other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 3 is a partially exploded view of the tower-to-floor support system shown in FIG. 2;

FIGS. 4-6 are representations of various operating phases of the tower-to-floor support system;

DETAILED DESCRIPTION OF THE INVENTION

Figure 1:
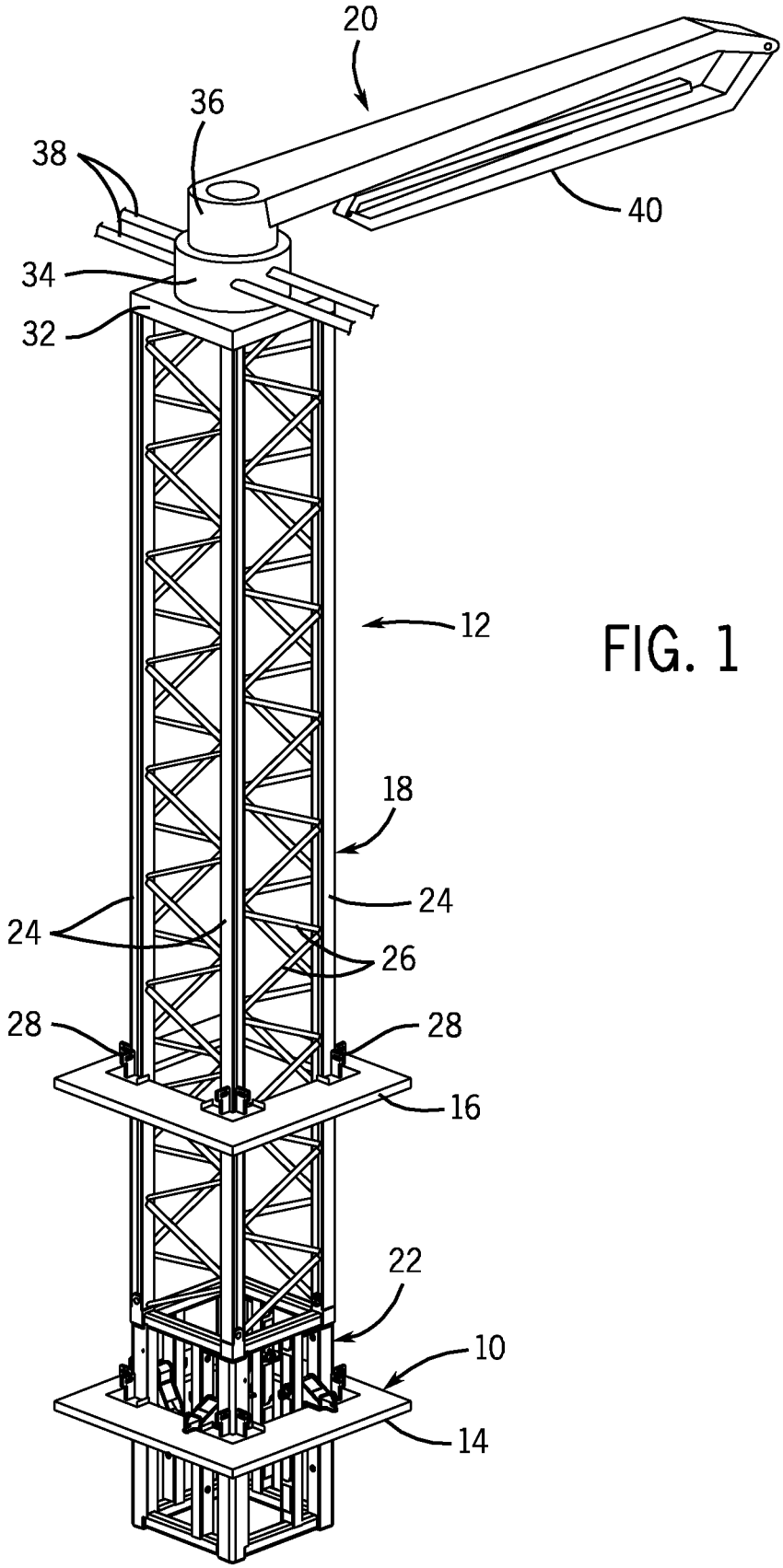
FIG. 1 is a perspective view of a vertically movable, tower-supported concrete placing boom securable to the floor structure of a building by means of a tower-to-floor support system.
Figure 2:
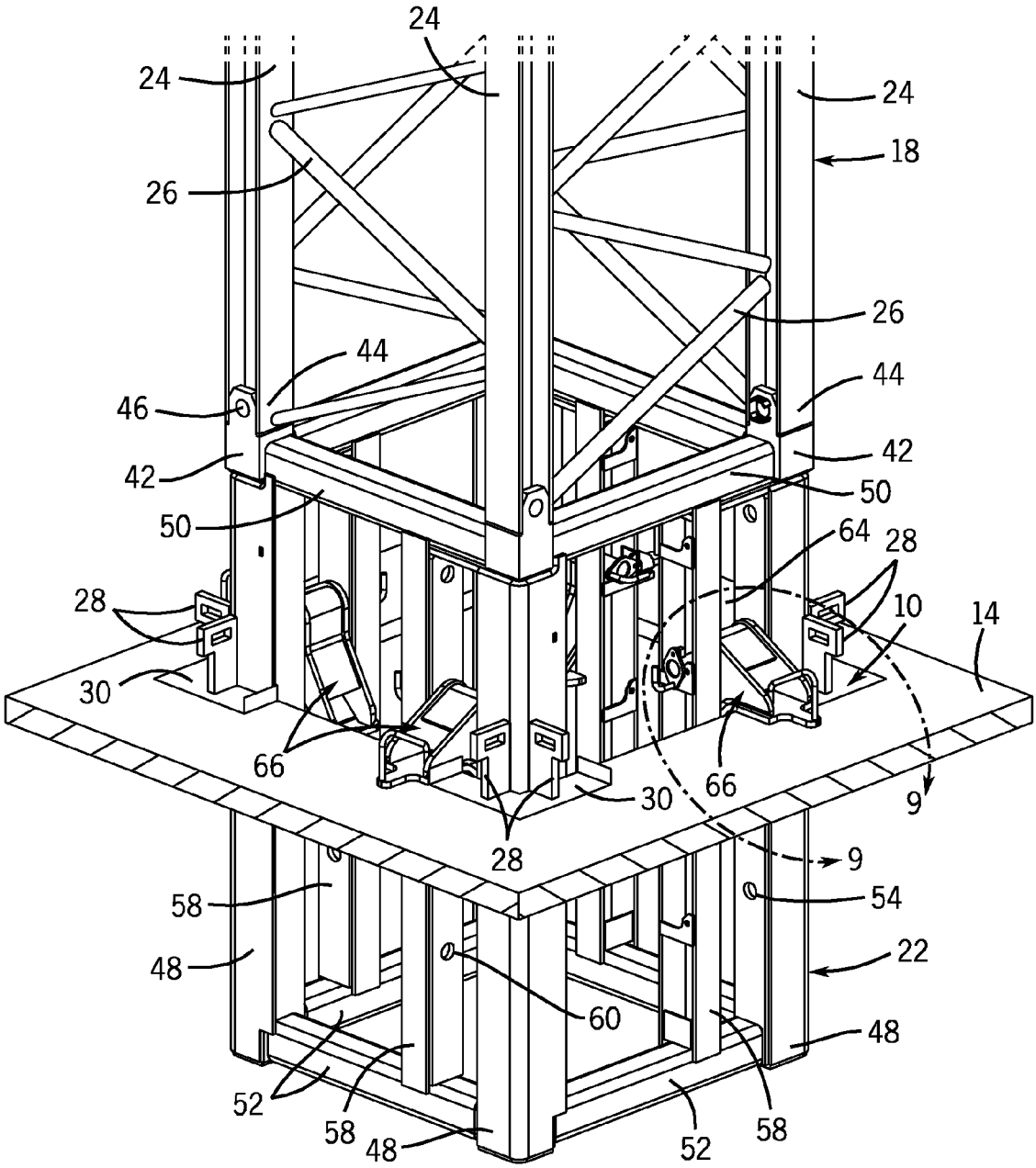
FIG. 2 is an enlarged view of a lower portion of FIG. 1.

FIGS. 1 and 2 illustrate a tower-to-floor support system 10 for supportably coupling a vertically movable support structure or pumping tower 12 to a floor structure 14 of a building under construction. As is known, the pumping tower 12 passes through an opening 15 (FIG. 4) in the floor structure 14 at a first or ground level, and extends upwardly through aligned openings 15 in subsequently completed upper floor structures such as shown at 16. As construction of the building progresses and new floor structures are added, the entire pumping tower 12 must be raised by a lifting device or jumped upwardly by a climbing system and secured to an upper floor structure 16 by means of the support system 10 embodying the present invention.

The pumping tower 12 includes a lattice tower 18 formed from one or more joined sections having a concrete placing boom 20 rotatably attached at an upper end, and a base or support framework 22 fixedly attached to the lower end. It should be understood that lattice tower 18 could be replaced by a support mast having a closed outer wall, if desired. The lattice tower 18 is an elongated support structure having four spaced apart vertical corner columns 24 interconnected by a series of diagonal braces 26 throughout the length of the structure. The corner columns 24 have outer surfaces which are frictionally engageable with wedges 28 as the pumping tower 12 is supported at each floor structure 14, 16. The wedges 28 are typically provided in pairs adjacent each corner of the floor opening 15, and are removably installed in slots formed in a plate 30 (FIG. 2) on the floor structures 14, 16. The wedges 28 provide stability so that the pumping tower 12 does not sway horizontally.

The upper end of the lattice tower 18 has a platform 32 provided with an adapter 34 for receiving a mounting block 36 of the concrete placing boom 20. The adapter 34 has an internal driving mechanism including a pinion (not shown) which is removably coupled to the mounting block 36, and is rotated about a vertical axis via a pair of toothed racks 38. Such tower adapter and boom mounting block coupling is more fully described in U.S. Pat. No. 6,675,822 issued Jan. 13, 2004. The mounting block 36 on the concrete placing boom is secured to an extendable and retractable arm assembly 40 for distributing concrete at the building site. Concrete is supplied through suitable delivery lines which run down the pumping tower 12 from the adapter 34 and mounting block 36 to a supply and pumping arrangement at a lower level.

The lower end of the lattice tower 18 is secured to connectors 42 at each upper corner of the support framework 22. The connectors 42 are bifurcated as seen in FIG. 3 to receive complementary-shaped feet 44 of the lattice tower 18, and then suitably anchored by pins 46 passing through the feet 44 and the connectors 42. It should be understood that if a support mast or closed tower is used in lieu of tower 18, the connectors 42 and feet 44 would take the form of an alternative connection system. As seen in FIG. 2, the support framework 22 includes four spaced apart vertical legs 48 aligned with corner columns 24 and connected together by upper cross members 50 and lower cross members 52. Each of the vertical legs 48 is provided with a series of vertically spaced apart holes 54. With further reference to FIG. 3, each corner of the support framework 22 is similarly constructed and includes a support plate 56 extending laterally from the upper end of each vertical leg 48. The support plate 56 has an outer end fixed to the top of a vertical rack 58 which extends downwardly to one of the lower cross members 52. Each vertical rack 58 is formed with openings 60 (FIG. 4) in alignment with the holes 54 provided in the legs 48. A number of stops 62 are connected to outer faces of the vertical racks 58 such that they are spaced slightly therefrom. The stops 62 are positioned adjacent the vertical rack openings 60, and are formed on their upper ends with pinholes 63.

Between each leg 48 and each vertical rack 58 is a space 64 for receiving a support bracket 66 having a mounting aperture 68 alignable with an aligned leg hole 54 and vertical rack opening 60. As will be appreciated, support brackets 66 permit a simplified highly effective support coupling of the pumping tower 12 to a floor structure 14, 16. Each support bracket 66 has a first portion 70 provided with a handle-like guide 72 with a first stop 74 that is engageable with the floor structure 14 or 16. Each support bracket 66 also has a second portion 76 which is longer than first portion 70 and includes a second stop 78 that is engageable with a respective leg 48 and rack 58. Each mounting aperture 68 receives a pivot pin 80 having an elongated cylindrical section 82 with a pointed end 84, and an opposite end provided with a face plate 86 and a handle 88. The face plate 86 has a passage 90 (FIG. 3) alignable with respective pinhole 63 for receiving a clevis pin 92 equipped with a spring retainer 94.

For initial installation at a first floor structure 14 surrounding the support framework 22, each support bracket 66 is positioned in a respective space 64 so that the mounting aperture 68 is aligned with leg hole 54 and vertical rack opening 60. Pivot pin 80 is held by handle 88 and cylindrical section 82 is passed through the aligned rack opening 60, mounting aperture 68 and leg opening 54. As seen in the partially installed support bracket 66 in FIG. 3, the face plate 86 has a tab 96 on its backside. When the face plate 86 contacts the stop 62, the face plate 86 is rotated 90 degrees to engage the tab 96 behind the stop 62. Then, the clevis pin 92 is inserted through face plate passage 90 and stop pinhole 63, and spring retainer 94 is attached to secure the pivot pin 80 in a locked position in which the handle 88 is now oriented horizontally. A completely installed support bracket 66 is shown towards the rear of FIG. 2. In the locked position, the pivot pin 80 cannot be laterally dislodged in any way.

FIG. 4 illustrates the completely installed position of three of the four support brackets 66 used in the support system 10. It can be seen that with the pumping tower 12 fully supported on the first floor structure 14, the first stop 74 is engaged with the top of the floor structure 14, while the second stop 78 is engaged with both the leg 48 and the vertical rack 58. Also, as seen in FIG. 2, each pair of wedges 28 is installed in the floor plate 30 at each corner of the floor structure 14 adjacent opening 15 so as to provide lateral stability for the pumping tower 12. FIG. 1 also shows that wedges 28 are similarly inserted on floor structure 16.

Figure 5:
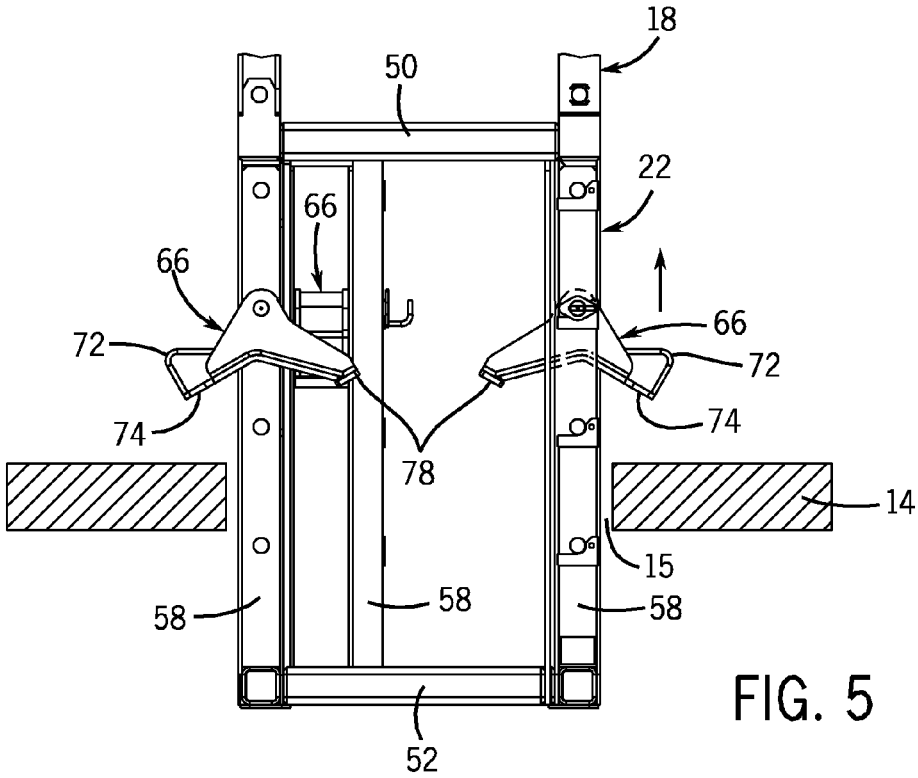
Figure 6:
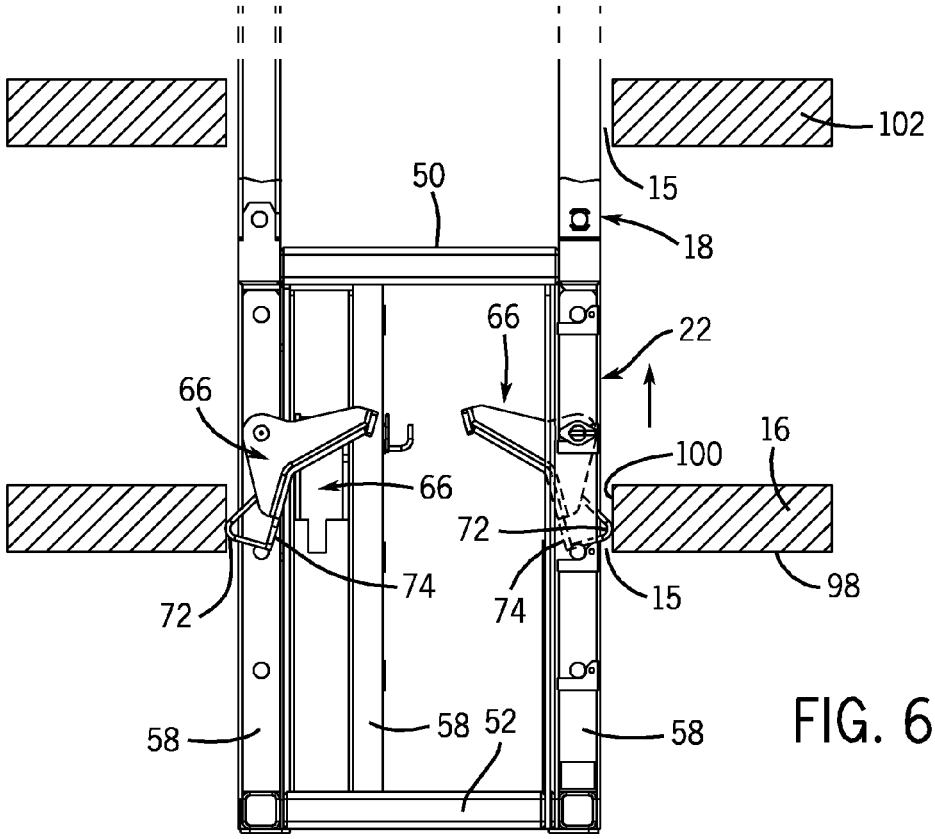

When it is desired to raise and secure the pumping tower 12 to a subsequently built or upper floor structure 16, the wedges 28 are removed from first floor structure 14 and second floor structure 16. In the example shown, the concrete placing boom 20 is uncoupled from the adapter 34 at the top of lattice tower 18, and a separate tower crane (not shown) is utilized to raise the pumping tower 12 upwardly as depicted in FIG. 5. Raising the pumping tower 12 causes the support bracket 66 to move away from and above the first floor structure 14, and to swing freely by gravity about pivot pin 80 according to the inherent weight distribution of the support brackets 66. In the disengaged freely swinging position of support bracket 66, the guides 72 and first stops 74 will extend outside the pumping tower 12. Further upward movement of pumping tower 12 through the opening 15 of the next upper floor structure 102 (FIG. 6) will cause engagement of the guides 72 with the bottom surfaces 98 of the fixed second or upper floor structure 16. This results in the support brackets 66 swinging (clockwise on one side of the support framework 22 or counterclockwise on the other side of the support framework) with the top of the guides 72 engaging the surface 100 forming the floor opening 15. The guides 72 prevent any binding that might occur between the floor structure 16 and the support bracket 66. The pumping tower 12 continues to be raised until the guides 72 and stops 74 sufficiently clear the top of the floor structure 16 after which the support bracket 66 will swing by gravity outwardly. The pumping tower 12 is then lowered slightly by the tower crane until the first stops 74 of support brackets 66 engage the top of floor structure 16 and the second stops 78 of support brackets 66 engage the legs 48 and the vertical racks 58 in a coupled position similar to FIG. 4. At this point, the pumping tower 12 is fully supported on upper floor structure 16. Wedges 28 are then installed on the floor structures 16, 102, tower crane may be disconnected from the top of lattice tower 18 and the concrete placing boom 20 is replaced at the top of lattice tower 18. This process is repeated for each subsequent floor structure constructed in the building.

In some cases, it may be desired to leave the concrete placing boom 20 in position on the pumping tower 12 during lifting by the tower crane. It should be understood that means other than a tower crane can be used to raise the pumping tower 12 given the fact that the removal/replacement of the concrete placing boom 20 leads to expensive pumping tower downtime. For example, the pumping tower 12 may be equipped with a specially designed jumping or climbing arrangement that hydraulically or electrically jacks the pumping tower 12 by using the floor structure as its support base. It should be further understood that the concrete placing boom 20 may be replaced by other boom structure such as a crane, if desired.

It should also be understood that instead of multiple leg holes 54 and vertical rack openings 60, a single aligned hole 54 and opening 60 may be formed in support framework 22 for each support bracket 66.

Figure 7:
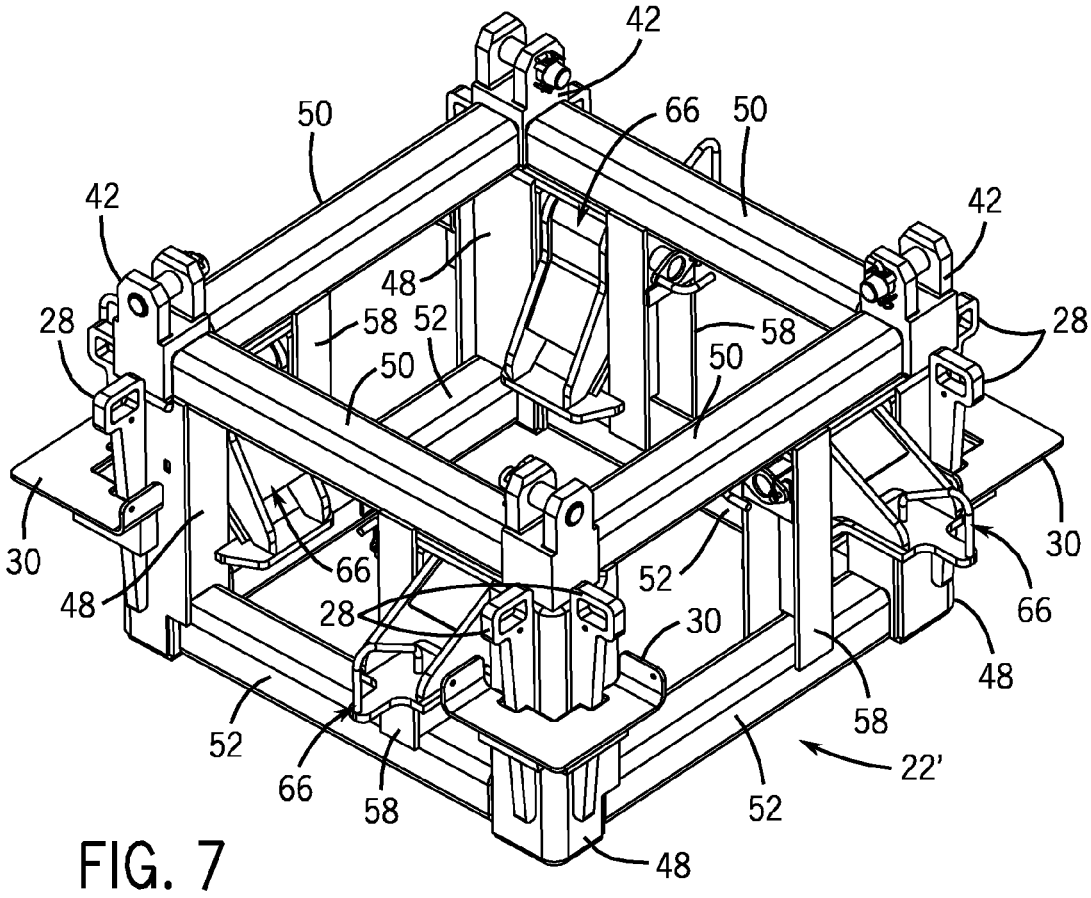
FIG. 7 is a perspective view of an alternative embodiment of the support framework used in the tower-to-floor support system of FIG. 1.

For example, FIG. 7 shows an alternate support framework 22' which is substantially identical to support framework 22 except for its shortened vertical height.

Figure 8:
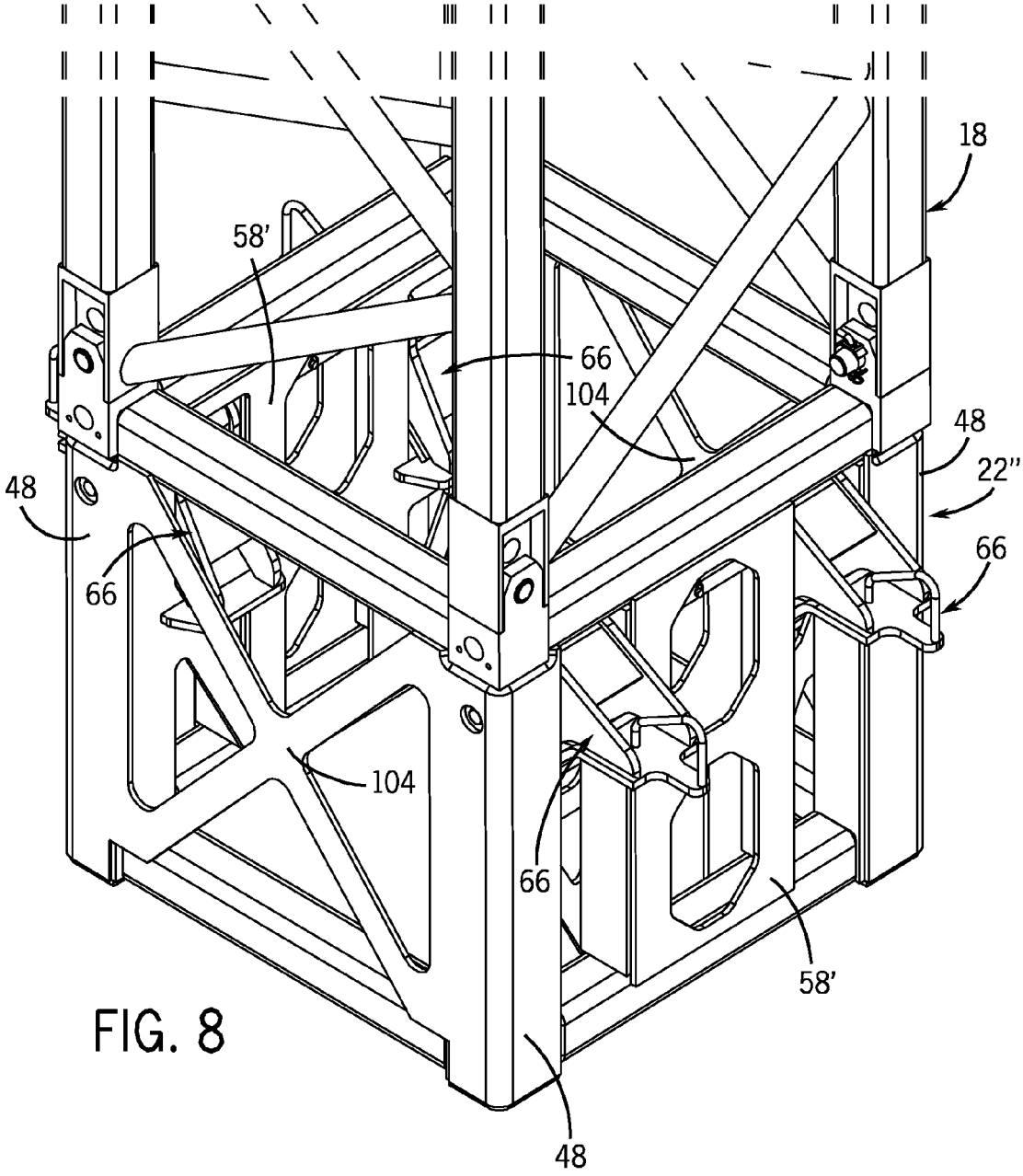
FIG. 8 is a perspective view of another alternative embodiment of the support framework supporting the lattice tower.

FIG. 8 illustrates a further alternate support framework 22" which is shown coupled as a base for lattice tower 18. Support framework 22" is similar to support framework 22' with the following exceptions. One pair of opposite sides of the support framework 22" is provided with cross braces 104 in place of vertical racks 58 and support brackets 66. The other pair of opposite sides of the support framework 22" includes a vertical rack 58' flanked by a pair of support of brackets 66 that are pivotably mounted relative to the legs 48 and the rack 58'. The vertical rack 58' and the pair of support brackets 66 take the place of the vertical rack 58 and the single support bracket 66 used in support framework 22'. Wedges 28 and corner plates 30 are shown removed for clarity.

Figure 9:
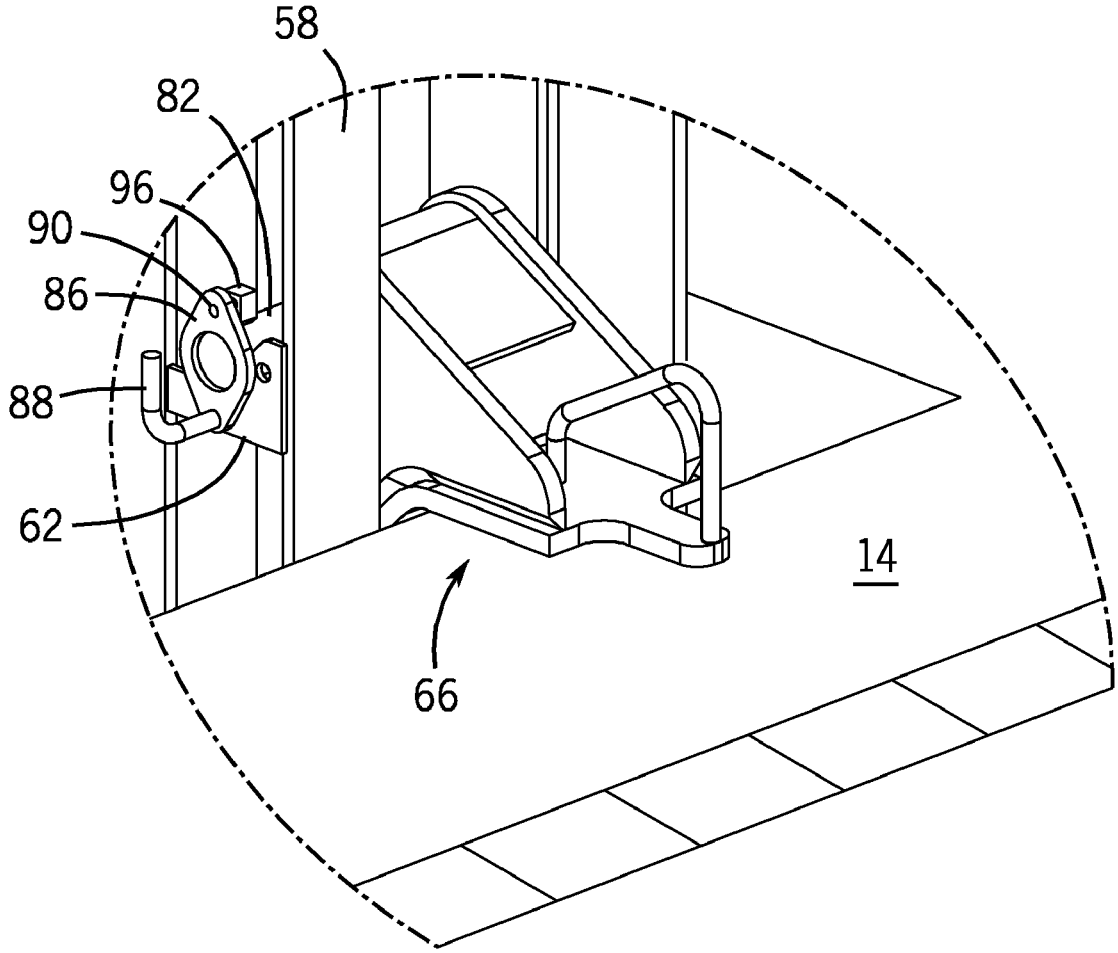
FIG. 9 is an enlarged view taken along line 9-9 of FIG. 1 showing the pivot pin in an unlocked position.

FIG. 9 illustrates the pivot pin in an unlocked position. In the unlocked position, tab 96 is spaced above the stop 62 such that the pivot pin can be removed by pulling on handle 88.

Figure 10:
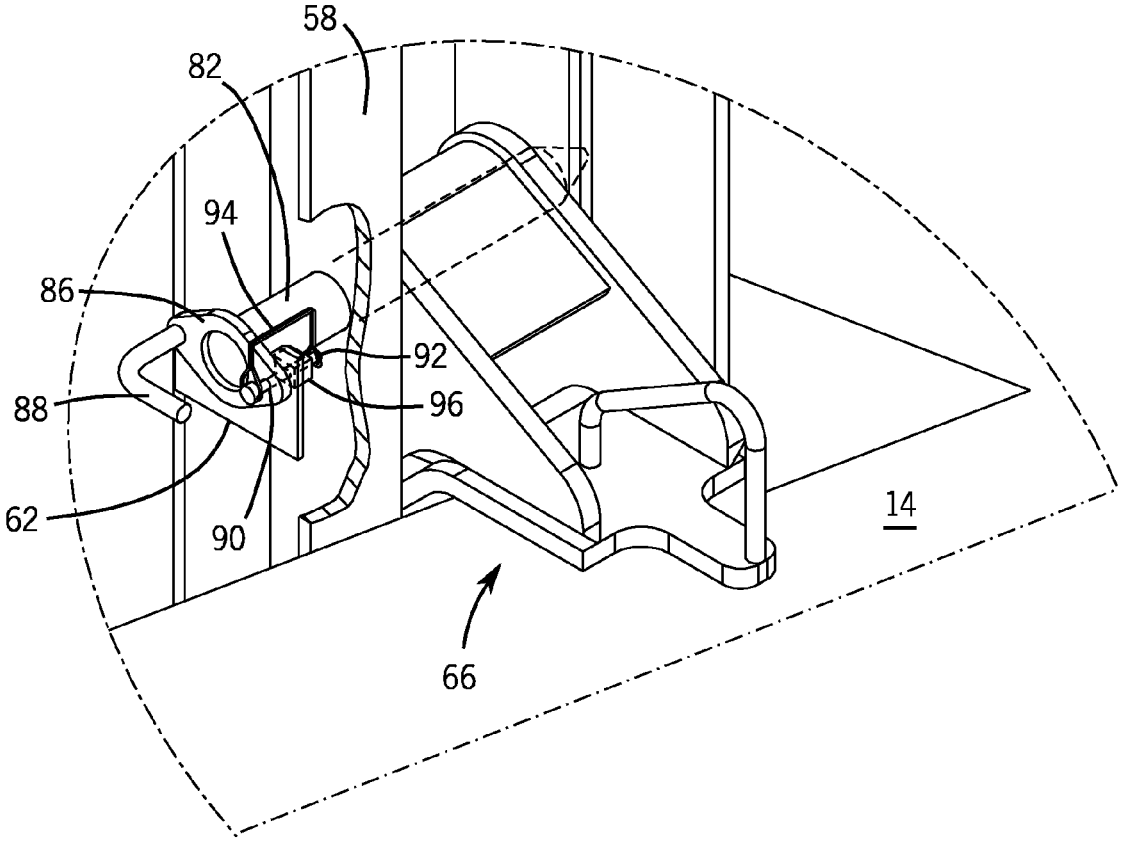
FIG. 10 is an enlarged view similar to FIG. 9 showing the pivot pin in a locked position.

In FIG. 10, the pivot pin is shown in the locked position. When the pivot pin is rotated 90° relative to FIG. 9, the tab 96 is engaged behind the stop 62. In this position, clevis pin 92 is inserted through the face plate passage 90 and the pin hole formed in the stop 62. The clevis pin 92 passes through an opening formed in the tab 96 and a spring retainer 94 is attached to secure the pivot pin in the locked position in which the handle 88 is oriented horizontally. In the locked position, the pivot pin cannot be laterally dislodged in any way.

A further contemplated alternative support framework comprises the integration of support framework 22 with lattice tower 18. Even though no illustration is provided, it should be apparent that said alternative design would be beneficial due to a reduced number of components and elimination of the connection joint between support framework and tower, while substantially retaining the features and functions of the current embodiment.

The present invention thus provides a substantially automatic tower-to-floor support system which will greatly decrease the time and effort involved in securing the pumping tower to floor structures of the building. The support system relies on freely swinging support brackets pivotably mounted on the corner structure of the pumping tower. The support brackets allow the pumping tower to be raised without restriction, swing inwardly of the surface forming the floor opening when contacting a subsequent floor structure, swing or flip outwardly beyond the wall forming the floor opening when raised above the floor structure, and positively support the pumping tower vertically when the pumping tower is lowered until the support brackets are fully engaged outwardly on top of the subsequent floor structure. The support system drastically improves upon the prior art floor-to-tower support devices that were time consuming and labor intensive to operate. The support brackets are independently mounted and do not require any powered moving device to be attached, or necessitate any manual securement during coupling of the pumping tower to the floor structure. The support system may be an adjustable version which uses the series of holes and openings as described herein, or a non-adjustable version which uses a single hole and opening for each support bracket in the support framework.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

What is claimed is:

1. A support system for supporting a support tower on a floor structure of a building, the support tower extending through an opening in the floor structure, the support system comprising:

a set of support brackets pivotably mounted relative to a support framework, the support brackets being supportably engageable with a first floor structure in a first supporting position, and being freely swingable and movably engageable with a second floor structure as the support framework is moved relative to the second floor structure enabling the support brackets to be supportably engageable with the portion of the support framework and the second floor structure in a second supporting position, wherein the support framework includes a series of vertical legs and vertical racks, and the support brackets are each pivotably mounted on a horizontal axis between the vertical legs and the vertical racks of the support framework, wherein each support bracket is swingable about a pivot pin having a cylindrical section and an opposite end provided with a face plate having a tab and a handle, wherein the pivot pin extends through a hole formed in the vertical leg, a mounting aperture formed in the support bracket and an opening formed in the vertical rack, wherein the vertical rack has a stop attached thereto adjacent the opening, wherein the handle and the face plate are rotatable to engage the tab behind the stop, and a retainer is passed through the face plate and the stop to lock the pivot pin in position.

2. The support system of claim 1 wherein the support tower has an upper end provided with a concrete placing boom, and a lower end connected to the support framework.

3. The support system of claim 1 wherein the support framework includes four sides, wherein at least one support bracket extends from each of the four sides of the support framework.

4. The support system of claim 1 wherein the support framework includes four sides, wherein the support brackets extend from only two of the four sides.

* * * * *